United States Patent [19]

Muller et al.

[11] Patent Number: 4,913,231

[45] Date of Patent: Apr. 3, 1990

[54] TOOL FOR TREATING SUBTERRANEAN WELLS

[75] Inventors: Laurent Muller, Sugar Land; Ervin Randermann, Beasley, both of Tex.

[73] Assignee: Dowell Schlumberger, Tulsa, Okla.

[21] Appl. No.: 282,437

[22] Filed: Dec. 9, 1988

[51] Int. Cl.[4] ..... E21B 47/00

[52] U.S. Cl. ..... 166/250; 166/64; 166/187; 166/373

[58] Field of Search ..... 166/250, 305.1, 310, 166/373, 385, 386, 387, 187, 240, 334, 64

[56] References Cited

U.S. PATENT DOCUMENTS

| | | | |
|---|---|---|---|
| 3,627,046 | 12/1971 | Miller et al. | 166/51 X |
| 4,286,661 | 9/1981 | Gazda | 166/334 X |
| 4,579,174 | 4/1986 | Barrington | 166/64 |
| 4,671,352 | 6/1987 | Magee, Jr. et al. | 166/334 X |
| 4,694,908 | 9/1987 | Morris et al. | 166/310 |

*Primary Examiner*—William P. Neuder

*Attorney, Agent, or Firm*—Stephen A. Littlefield

[57] ABSTRACT

A method and apparatus for treating subterranean wells includes a tool supported on a one-piece support tube which operates to raise and lower the tool in the well to a position where well treatment is required. The tool provides inflatable packers and a selector valve operable in a first position to inflate or deflate the packers, in a second position to circulate fluid to spot treatment fluid at the tool, and a third position for injecting treatment fluid into the strata isolated from the remainder of the well by the packers. The tool provides a J-lock system and a time delay dashpot which cooperate to permit an operator at the well head to selectively operate the valve between the three positions solely by adjusting the weight on the support tube at the well head.

26 Claims, 14 Drawing Sheets

TOOL FOR TREATING SUBTERRANEAN WELLS

BACKGROUND OF THE INVENTION

This invention relates generally to the treatment of subterranean wells and the like, and more particularly to a novel and improved tool for the treatment of wells particularly suited for use with one-piece coiled support tubing.

PRIOR ART

It is known to provide continuous lengths of coiled tubing to support tools within subterranean wells, and through which various fluids may be pumped to a tool mounted on the end of the coil. U.S. Letters Pat. No. 4,585,061 discloses a system for inserting and withdrawing such coiled tubing with respect to a well. Such patent is incorporated herein in its entirety to describe such a system.

Since such tubing is a single, continuous tube, it cannot be rotated and can only be raised and lowered. Therefore, if such tubing is used to position a treatment tool within a well, rotary movement cannot be used to control the various functions of the tool. Consequently, it is difficult to employ such tubing with a tool such as a straddle packer tool or the like for the treatment of wells.

SUMMARY OF THE INVENTION

It is one important aspect of this invention to provide a method and apparatus in which a treatment tool is sequenced in its operation through a full treatment cycle by merely adjusting the load on the grippers which raise or lower a one-piece tool support tube at the well head. Further, the load on the grippers establishes that the tool has been properly cycled.

In accordance with another aspect of this invention, a novel and improved time delay selector valve is provided which can be operated from a remote location by adjusting tension in a support tube. Further, a novel and improved equalizer valve is provided.

In accordance with still another aspect of this invention, a novel and improved method is provided to form cam surfaces on the interior of a tube which may be relatively small in diameter and relatively long.

In normal operation of the illustrated embodiment of this invention, the tool packers are first positioned while deflated at the location within the well where treatment is desired. By properly sequencing changes in the pull on the tube, valves within the tool are moved to sequence the tool operation. In the illustrated embodiment, straddle packers are provided which, when inflated, isolate the portion of the well between the packers from the remainder of the well.

By adjusting the load on the tubing, the valves within the tool are sequentially operated to:

(1) provide inflation of the packers;

(2) provide an injection test to determine if the fluid can be injected into the sealed-off portion of the well;

(3) provide circulation to displace the non-treatment fluid from the tube and spot the treatment fluid at the tool;

(4) inject the treatment fluid into the strata of the well between the packers; and (5) after treatment is completed, deflate the packers, allowing the tool to be repositioned at another treatment location, or removed from the well.

The tool is often located many thousands of feet down the well. Therefore, the supporting tubing is long and quite heavy. Because of stretch in the tubing and the like, movement of the tube at the surface of the well, either up or down, does not necessarily produce a corresponding movement of the tool. Therefore, the sequencing of the valves in the tool is controlled by selectively changing the pull or load on the tube at the surface. This provides the operator with an accurate indication of the operation of the valves to permit the operator to control the sequence of operations of the tool.

In the illustrated embodiment, the tool is provided with three interrelated valves. A drag valve is provided with drag springs which engage the well surface. When the tool is being lowered into the well, this drag valve remains open; however, raising the tool causes the valve to move to its closed position. A time delay sequencing valve is also provided. The sequencing valve provides a dashpot or damper which causes a time delay when the valve is moved in one direction. The sequencing valve also provides a J-lock cam system, permitting the positioning of the sequencing valve in an intermediate position for circulation or spotting. The three-position sequencing valve is also controlled by adjusting the load at the surface. The third valve is an equalizer valve and is also operated at the surface by adjusting the support tubing load.

With this invention, a reliable mechanical treatment tool is provided which is sequenced in its operation without rotation of the supporting tube and which can be used to perform multiple treatment sequences at various locations in the well without being removed from the well.

Also in the illustrated embodiment, the required J-lock internal camming surfaces are formed by a novel and improved method. These camming surfaces are cut in the outer surface of a cylindrical mandrel. The mandrel is then positioned within an outer tube and is button-welded to an outer tube through holes formed in the tube. The center of the mandrel is then bored out, leaving only the camming surfaces which are secured to the outer tube by the button welds.

These and other aspects of this invention are illustrated in the accompanying drawings, and are more fully disclosed in the following specification.

BRIEF DESCRIPTION OF THE DRAWINGS

FIG. 9 schematically illustrates the tool in the run-in position;

FIG. 9*a* schematically illustrates the condition of the J-lock assembly during run-in;

FIG. 9*b* illustrates the string weight provided by the weighing scale during run-in;

FIG. 10 schematically illustrates the tool in the packer inflation condition.

FIG. 11 schematically illustrates the tool in the injection test position.

FIG. 12 schematically illustrates the tool in the spotting or circulating position, and FIGS. 12*a* and 12*b* correspondingly illustrate the J-lock assembly and weight scale reading;

FIG. 13 schematically illustrates the tool in the injecting position.

FIG. 14 schematically illustrates the tool in the deflation position, and FIGS. 14*a* and 14*b* correspondingly illustrate the J-lock assembly and the weight scale reading.

DETAILED DESCRIPTION OF THE DRAWINGS

Figure 1:
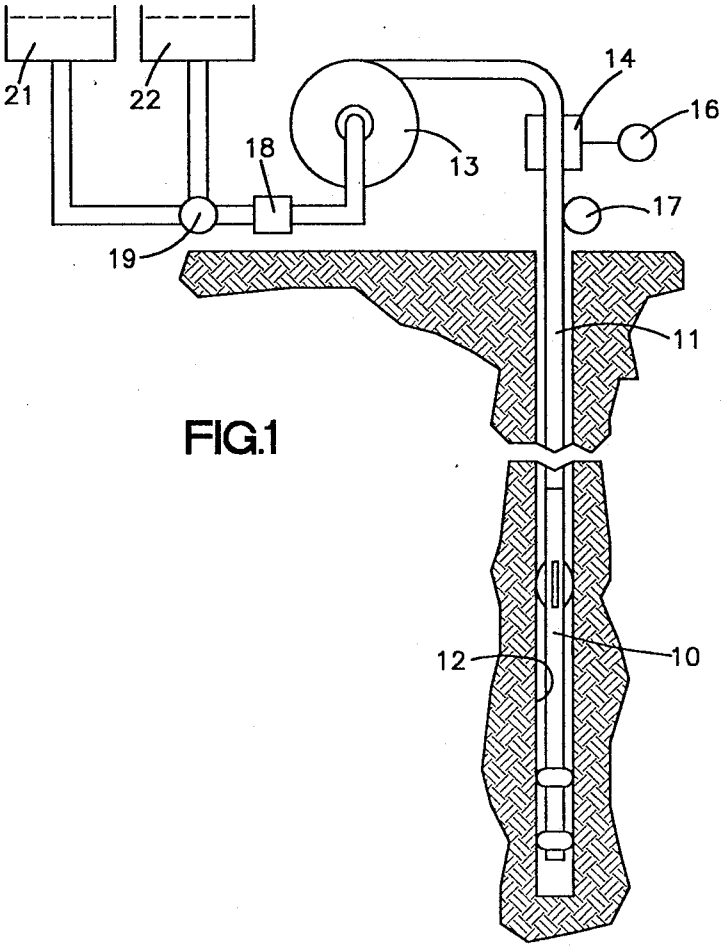
FIG. 1 is a schematic representation of an entire well treatment system, in accordance with the present invention.

FIG. 1 schematically illustrates the entire well treatment system in accordance with the present invention. The system includes a treatment tool 10 connected to one end of a one-piece, flexible tube 11 which functions to position the tool 10 at a desired location in a well 12. The tube 11 also functions to supply fluid to the tool 10. The tool in accordance with the present invention is particularly suited for use with one-piece support tubing because it does not require rotation for its operation. However, the tool can also be used with support tubes consisting of connected tubing sections.

The opposite end of the tube is coiled and stored on a drum 13 and passes from the drum 13 through powered grippers 14 which function to control the extension or retraction of the tube to raise and lower the tool 10 within the well 12. Connected to the grippers 14 is a weight measuring scale 16 which permits the operator to determine the weight of the tube 11 and the tool 10 being supported by the grippers 14 at any given time.

When the string, consisting of the tube and the tool, is being lowered into the well 12, the frictional drag of the string along the surface of the well reduces the load supported by the grippers 14 and provides a run-in weight. When the string is being raised, the frictional drag increases the tension in the tube and provides a pull-up weight or lifting weight. These weight differences are recorded by the operator when the tool is positioned for treatment, and are utilized in the control of the tool, as discussed below.

In addition, the system includes a measuring device 17 which engages the surface of the tube and provides the operator with an indication of the length of the string, and consequently an indication of the position of the tool within the well. Reference should be made to U.S. Pat. No. 4,585,061, supra, incorporated herein by reference, for a detailed description of a typical system for controlling the raising and lowering of the string within the well.

In addition, the system includes a pump 18 connected through a valve 19 to selectively connect the valve to a reservoir of inflation fluid 21 or a reservoir of treatment fluid 22. The output of the pump is connected to the end of the tube 11 on the drum 13, so that either inflation fluid or treatment fluid can be pumped down the tube 11 to the tool 10, as described below.

Because the tool is often lowered very great distances down a well, and because the tube 11 tends to stretch or contract when the tension therein is changed, the tool 10 in accordance with the present invention is sequenced through its various operating conditions based upon adjusted loads on the grippers 14 as indicated by the weight scale 16. The control of the tool does not require rotary control movement, and is not affected by variations in the stretch of the tube 11 extending along the length of the well 12.

Figure 2:
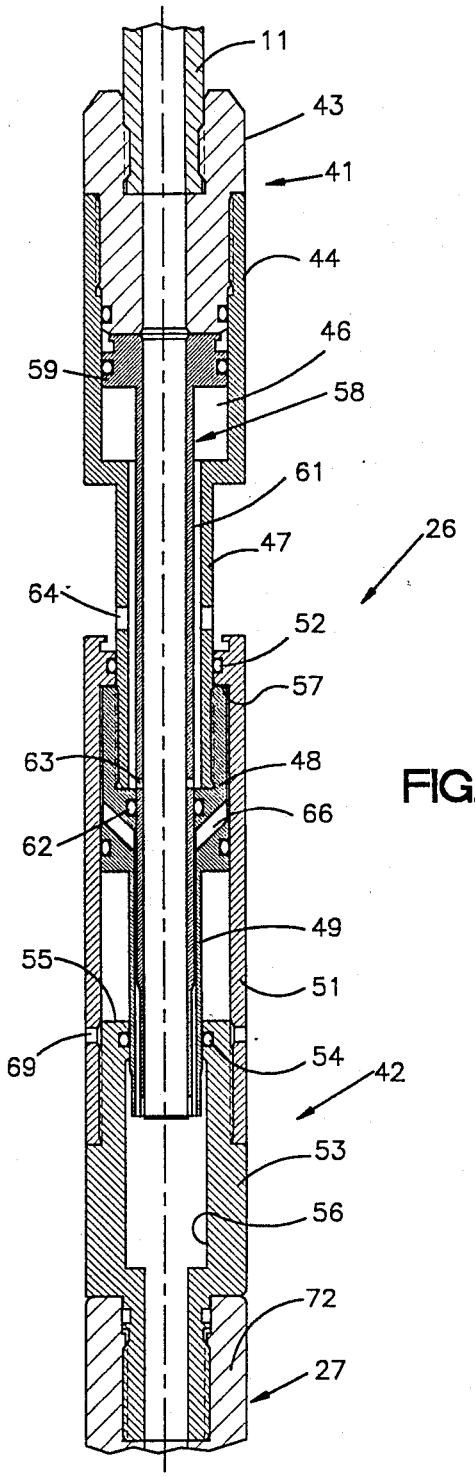
FIG. 2 is a fragmentary, enlarged, longitudinal section, taken at the upper end of the tool and illustrating the equalizing valve provided by the tool.
Figure 3:
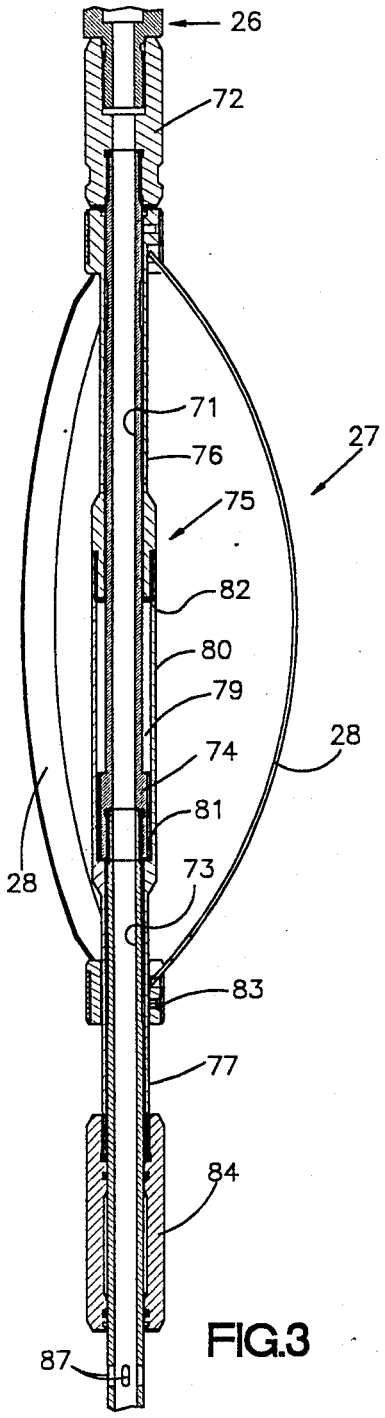
FIG. 3 is a fragmentary, longitudinal cross section of a portion of the tool immediately below the equalizing valve illustrated in FIG. 2 and illustrating the drag valve portion of the tool.
Figure 4:
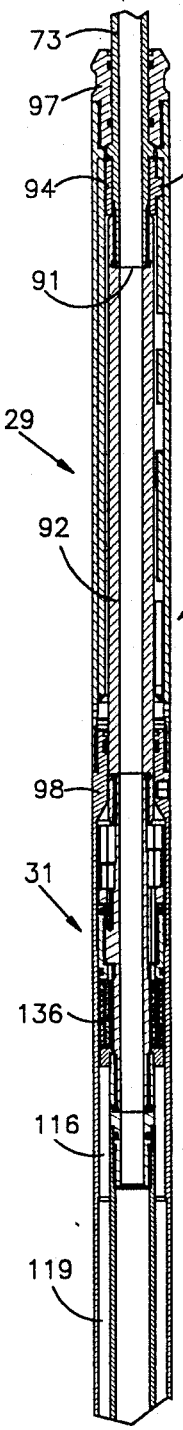
FIG. 4 is a fragmentary, longitudinal section illustrating a portion of the tool immediately below the drag valve illustrated in FIG. 3, which includes a J-lock assembly and a dashpot or time delay assembly.
Figure 5:
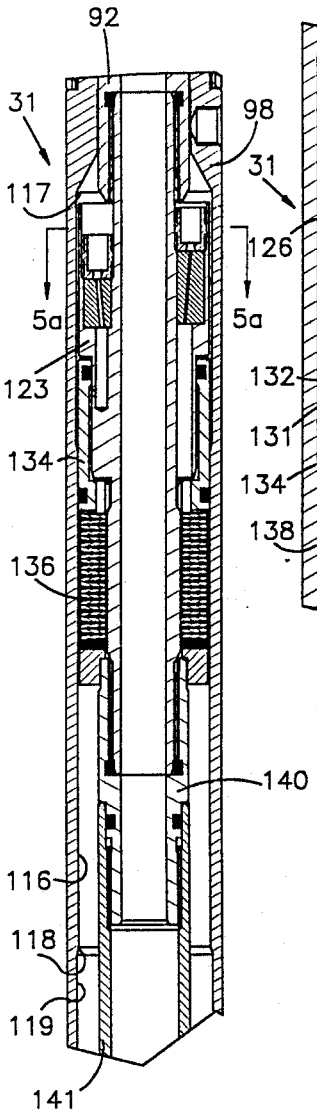
FIG. 5 is an enlarged, fragmentary, longitudinal section of the portion of the tool including the time delay or dashpot assembly.
Figure 6:
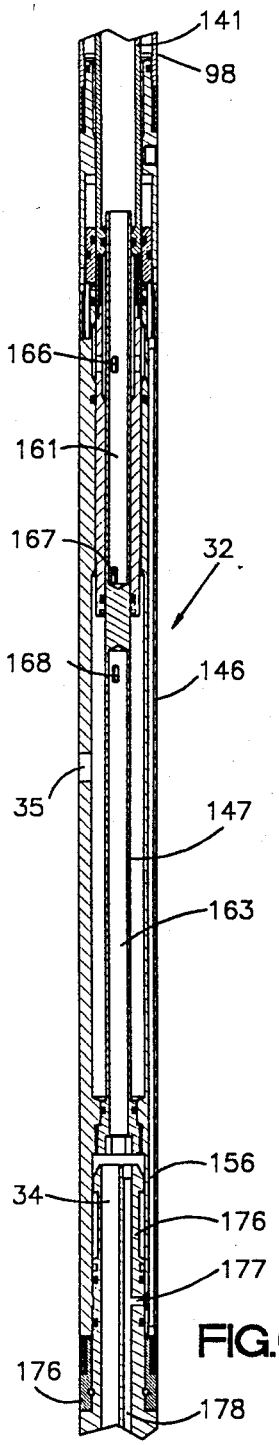
FIG. 6 is a fragmentary, longitudinal section of the selector valve in the run-in position in which the packers are inflated or deflated.

FIGS. 2 through 6 are fragmentary sections which cooperate to illustrate the entire tool 10 in accordance with this invention. These fragmentary sections are taken from the top of the tool at progressive intervals along the length of the tool, with FIG. 2 illustrating the upper portion of the tool, FIG. 3 illustrating the next portion of the tool, and FIGS. 4 through 6 illustrating progressively lower portions of the tool.

FIG. 2 illustrates an equalizing valve assembly 26 which functions during the deflation portion of the cycle of the tool operation to relieve the pressure within the tool and equalizes the internal pressure with the environmental pressure surrounding the tool. Immediately below the equalizing valve assembly 26 is a drag valve assembly 27 illustrated in FIGS. 3 and 3*a*. The drag valve assembly 27 provides a plurality of leaf springs 28 which resiliently press against the surface of the well to provide a frictional engagement which resists movement of the drag valve with respect to the well when the tool is raised or lowered within the well.

Figure 4A:
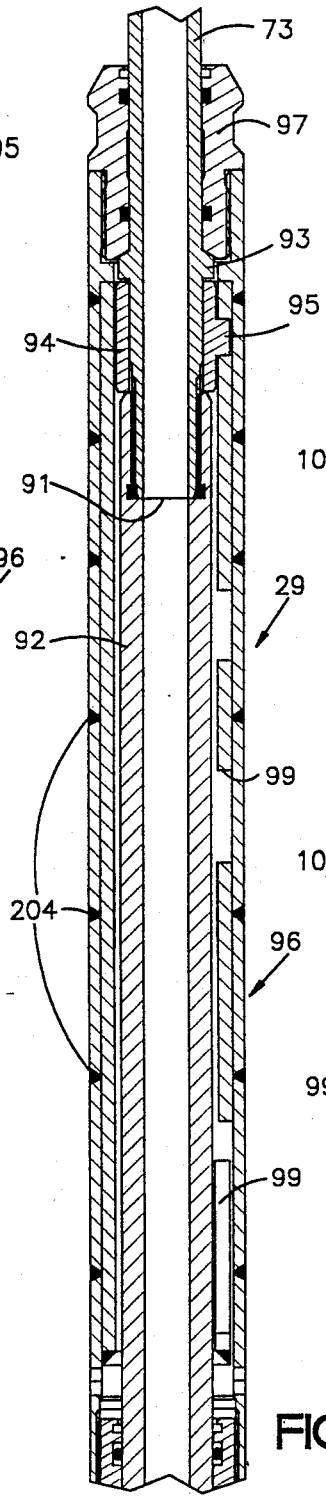
FIG. 4*a* is an enlarged, fragmentary, longitudinal section of the J-lock assembly.

Immediately below the drag valve assembly 27 is a J-lock cam system 29 illustrated in FIG. 4. As described in detail below, this J-lock cam system cooperates with a time delay dashpot assembly 31, also illustrated in FIG. 4. An enlarged, fragmentary section of the J-lock cam assembly 29 is illustrated in FIG. 4*a* and an enlarged, fragmentary section of the time delay dashpot assembly 31 is illustrated in FIG. 5. This time delay dashpot assembly 31 permits the operator to position the selector valve in one of three selected operating conditions, as discussed in detail below.

Figure 8:
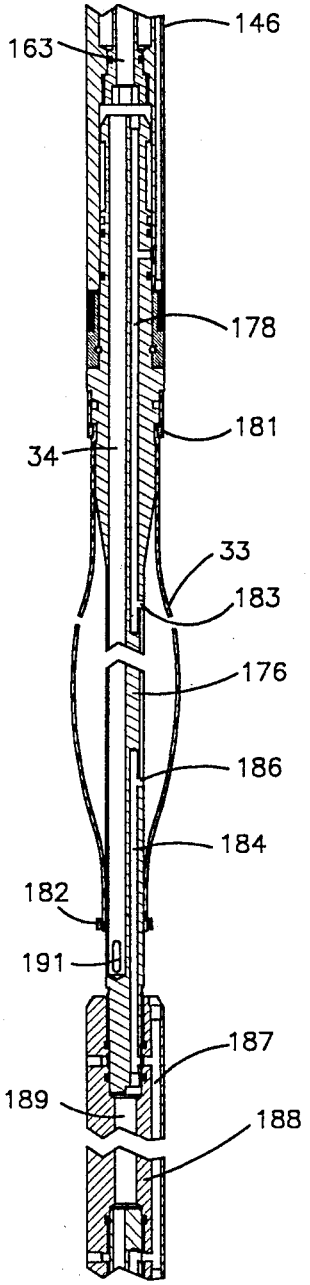
FIG. 8 is a longitudinal section of a portion of the packer subassembly, illustrating one of the two spaced packers.

Positioned immediately below and connected to the time delay dashpot assembly 31 is a selector valve assembly 32, illustrated in FIG. 6. The selector valve assembly 32 is a three-position valve. In one position, it connects the pressure within the tool to inflatable packers 33, one of which is illustrated in FIG. 8. In a second position of the selector valve assembly 32, supply pressure to the tool is connected to circulation ports 35, as illustrated in FIG. 6*b*. In such second position, the portion of the well between the packers is also connected to the circulation port 35 to equalize the pressure of the portion of the well between the packers and the well portion above the packers. In the third position, the selector valve assembly 32 connects the supply pressure to the tool to a passage 34 (illustrated in FIG. 6) for the injection of the treatment fluid into the strata of the well between the packers 33.

The Equalizing Valve

The equalizing valve, best illustrated in FIG. 2, provides an upper housing assembly 41 and a lower housing assembly 42. The upper housing assembly is connected to the lower end of the tube 11 which supports the entire tool 10. Normally, an adjustable pressure relief valve and a check valve (neither of which is illustrated) are provided at the lower end of the tube between the tube 11 and the upper housing assembly 41 to prevent backflow of liquid up along the tube 11 and also to protect the system from over-pressurization. Since such back check valves and adjustable relief valves are known to persons skilled in the art, they are not illustrated herein.

The upper housing assembly 41 includes a tubular connector 43 threaded into the end of an elongated housing member 44 which cooperates with the connector 43 to define a cylinder chamber 46 and provides a tubular extension 47. The lower end of the tubular extension 47 is threaded into a balancing piston 48, which, in turn, is provided with a tubular extension 49.

The lower housing assembly 42 includes an outer tube member 51 providing a seal 52 at its upper end engaging the outer surface of the tubular extension 47. The lower end of the outer tube member 51 is threaded onto a tubular coupling member 53. The tubular extension 49 of the balancing piston 48 extends through a seal 54 into a central passage 56 in the tubular member 53. The lower end of the member 53 is threaded into an upper connector 72 of the drag valve assembly 27.

The two housing assemblies 41 and 42 are connected for telescoping movement between an extended or run-in position in which the balancing piston 48 is in engagement with a shoulder 57 on the outer tube member and an inward telescoped position in which the balancing piston 48 engages the end 55 of the tubular member 53.

A centrally located, tubular piston member 58 provides a piston head 59 within the cylinder chamber 46 and a tubular rod portion 61 extending through the balancing piston 48 and a seal 62 therein. In the run-in position, the friction of the seals 62 maintains the piston member 58 in the upper position in which the piston head 59 engages the lower end of the tubular connector 43. In such position, an orifice or port 63 connects the interior of the tubular rod portion 61 to the interior of the tubular extension 47. Further, when the two housing assemblies 41 and 42 are in their extended position, a port 64 provides communication between the interior of the tubular extension 47 and the surrounding portion of the well. Therefore, in the run-in position illustrated in FIG. 2, fluid pumped down the tube 11 to the tool 10 is vented to the surrounding portion of the well through the ports 63 and 64.

However, the equalizing valve 26 is structured so that when the flow of fluid into the tool exceeds a predetermined amount, such as about 0.2 barrel per minute, the equalizing valve is closed. In order to provide such closing action, the port 63 is sized to be substantially smaller than the port 64. When the flow rate of fluid to the tool is increased, a pressure drop occurs through the port 63 which is sufficient to cause a differential pressure across the piston head 59. This causes the piston head 59 to be moved down along the upper housing assembly 41 a sufficient distance to move the port 63 past the seal 62 in the balancing piston 48 to close the equalizing valve 26.

The equalizing valve is also closed when the two housing assemblies 41 and 42 are telescoped together to move the port 64 past the seal 52 in the outer tubular member 51. Movement of the two housing assemblies 41 and 42 to the closed or fully telescoped position, however, causes the lower end of the tubular rod portion 61 to engage a shoulder at the lower end of the passage 56. This also functions to reposition the piston member 58 in its upper position within the upper housing 41 in which the port 63 is above the seals 62 and the balancing piston 48.

The balancing piston 48 functions to prevent high pressure within the tool from extending the two housing assemblies 41 and 42. In balancing operation, high pressure within the tool is communicated to the upper side of the balancing piston 48 through a port 66. A port 69 maintains the lower side of the balancing piston at environmental well pressure. The high pressure on the upper side of the balancing piston produces a downward balancing force on the upper housing assembly 41, counteracting the pressure-induced force tending to cause the upper housing assembly 41 to move up relative to the lower housing assembly 42.

The Drag Valve

Figure 3A:
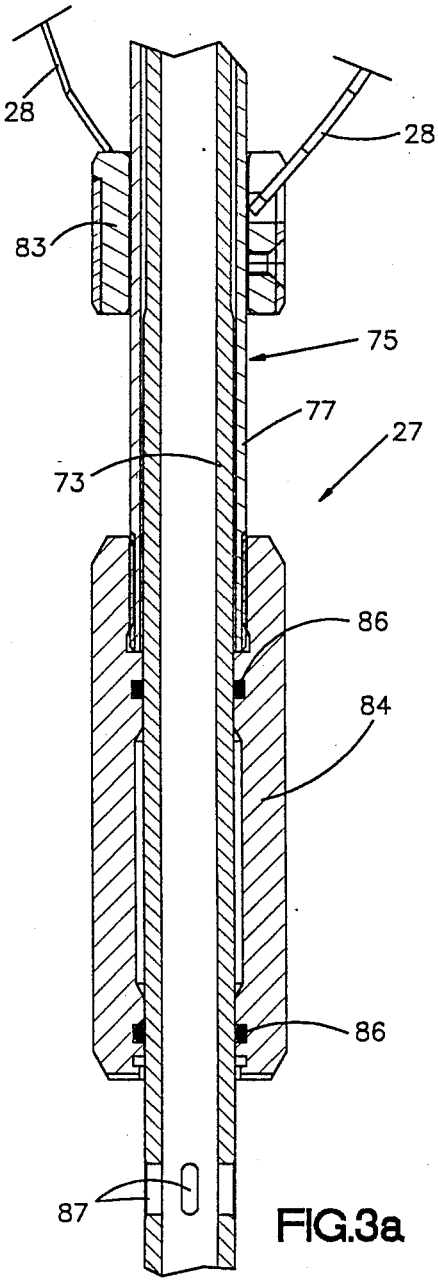
FIG. 3*a* is an enlarged, fragmentary, longitudinal section illustrating the structural detail of the valve portion of the drag valve.

Referring now to FIGS. 3 and 3*a*, the drag valve assembly 27 includes an upper tubular member 71 threaded at its upper end into the coupler 72 which connects with the equalizing valve assembly 26. A lower tubular member 73 is threaded into the lower end of the upper tubular member 71. An enlarged portion 74 is provided at the lower end of the upper tubular member 71.

Positioned around the two tubular members 71 and 73 is a sleeve assembly 75 consisting of an upper sleeve 76 and a lower sleeve 77. The upper end of the lower sleeve 77 is provided with an enlarged portion 80 which cooperates with the end of the upper sleeve to provide a chamber 79 enclosing the enlarged portion 74.

Mounted on the sleeve assembly 75 are a plurality of leaf springs 28 which are arched in an outward direction to provide a resilient engagement with the surface of the well 12 and produce a frictional drag with respect to the well which resists movement of the sleeve assembly with the tool as the tool moves either up or down along the well. During the run-in, the frictional drag provided by the springs 28 causes the sleeve assembly 75 to move to an upper position relative to the tool, in which the enlarged portion 74 engages a shoulder 81 in the sleeve assembly 76. When the tool is raised, the frictional engagement between the springs 28 and the well surface resists upward movement of the sleeve assembly 75 with the tool, and the sleeve assembly assumes a lower position in which the enlarged portion 74 engages the end 82 of the upper tubular member 71.

The lower ends of the springs 28 are mounted in a collar 83 which is slidable along the sleeve assembly 75 to permit the springs to flex in and out so that they can follow the contour of the wall of the well and maintain resilient frictional engagement therewith. The springs 28 are relatively long so that they can extend a substantial distance to engage the well casing after passing through a relatively small diameter production tube.

Threaded onto the lower end of the sleeve assembly 75 is a valve sleeve member 84 which is longitudinally movable relative to the lower tubular member 73 and provides spaced seals 86 which dynamically seal with the outer surface of the lower tubular member 73. During the run-in of the tool, in which it is lowered into the well, the sleeve valve member is held in its upward position by the frictional engagement between the leaf springs 28 and the well surface, and in such position the lower seal 86 is above ports 87 in the lower tubular member. Therefore, the drag valve assembly 27 is in an open position, allowing circulation of liquid pumped down into the tool 10 through the tube 11. However, if the tool is raised, the frictional engagement between the springs 28 and the well surface causes the sleeve valve member 84 to move down relative to the inner tubular members to close the ports 87. Therefore, the drag valve is responsive to the direction of movement of the tool 10 and is open when the tool is being lowered in the well and closed when the tool is being raised.

The J-Lock Assembly

Figure 4B:
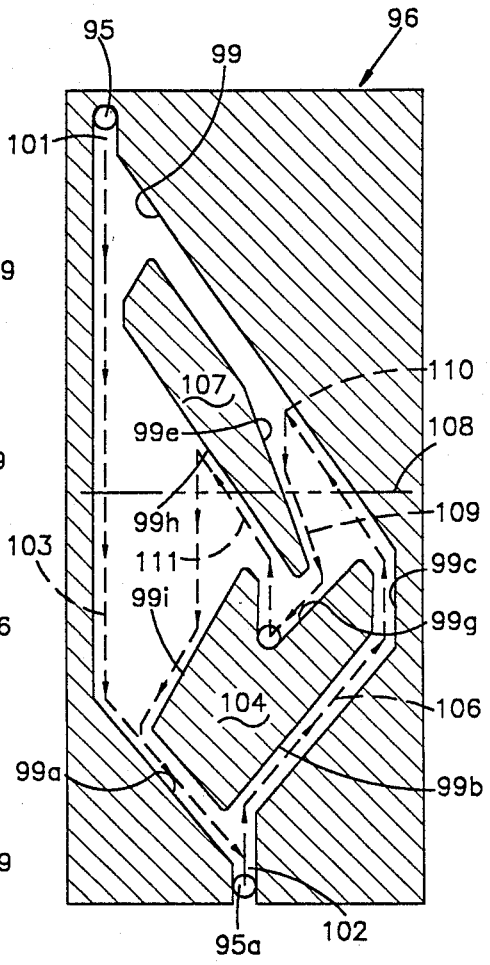
FIG. 4*b* is a rolled-out view of the J-lock cam structure as it would appear when viewed from the longitudinal centerline of the tool.

The J-lock assembly 29 is illustrated in FIGS. 4, 4*a*, and 4*b*. FIG. 4*b* is a rolled-out view of the J-lock cam structure illustrating the cam structure as a plane as it would appear from the central longitudinal axis of the tool.

The lower tubular member 73 extends beyond the lower end of the drag valve 27 to an end 91 which is threadedly connected to an intermediate tubular member 92. Positioned between a shoulder 93 on the tubular member 73 and the upper end of the intermediate tubular member 92 is a cam follower ring 94 which is free to rotate around the central axis of the tool but is held against axial movement relative to the tubular members 73 and 92. The cam follower ring 94 provides a projection 95 extending radially outward from the ring.

Positioned around the tubular member 73 is a J-lock cam sleeve assembly 96 threaded into a gland ring 97 at its upper end and into a cylinder sleeve 98 at its lower end. The J-lock cam sleeve assembly 96 is axially movable along the tubular members 73 and 92 and is provided with a camming surface 99 shaped as best illustrated in FIG. 4*b*. The follower projection 95 engages the camming surface 99 and moves with the selector valve assembly between three operating positions, as described in detail below.

Referring to FIG. 4*b*, the cam surface 99 includes an upper pocket 101 and a lower pocket 102. During the run-in of the tool, the follower projection 95 is positioned in the upper pocket 101.

The cam surfaces are shaped so that if the tubular members 73 and 92 move downwardly relative to the J-lock cam sleeve assembly 96, the follower projection 95 moves directly down along a first path 103, indicated by direction arrows, until it engages an inclined camming surface 99*a*, along which it moves into the pocket 102, as indicated at 95*a*.

If the follower projection 95 is in the lower pocket 102 and the tubular members 73 and 92 are raised relative to the J-lock cam sleeve assembly 96, the follower projection 95 engages the inclined underside 99*b* of a first island cam portion 104 along which it moves along a second path 106. As the movement continues, the follower projection moves along a vertical cam portion 99*c* into engagement with an inclined cam surface portion 99*d* and up alongside a second island cam portion 107. The line 108 indicates the relative position between the J-lock cam sleeve assembly 96 and the tubular members 73 and 92 above which flow-restricting orifices commence to operate to resist the movement of the follower projection 95 in an upward direction. This damping or time delay function and the structure for producing it are discussed in detail below.

After passing the position indicated by the line 108 a position is reached at 110 before reaching a position in alignment with the upper end of the second island 107 The direction of relative movement is then reversed by reducing the tension in the support tube 11. The follower projection 95 then moves down along the upper surface 99*e* and drops into a J-lock pocket 99*g* to hold the selector valve in an intermediate position. In that position, circulation of fluid through the tool is provided, as discussed below. On the other hand, if the relative movement is not reversed, the follower projection 95 returns to the upper pocket 101.

The movement path 109 indicates the path of the follower projection 95 to the J-lock pocket 99*g*.

Once in the J-lock pocket 99*g*, upward movement of the follower projection 95 relative to the J-lock cam sleeve assembly 96 causes the follower projection 95 to move vertically upward along the path 111 and along the underside 99*h* of the second island cam portion 107 past the position indicated by the line 108. If such upward travel is continued, the follower projection 95 moves into the upper pocket 101.

On the other hand, if such upward travel is reversed, the follower projection 95 moves into engagement with the inclined cam surface 99*i* and returns to the lower pocket 102.

With this structure, the selector valve described in detail below can be moved in such a way that the valve can be moved to either extreme position from the J-lock pocket 99g by merely timing the increased tension force applied to the support tube 11.

The Time Delay Dashpot Assembly

Figure 5B:
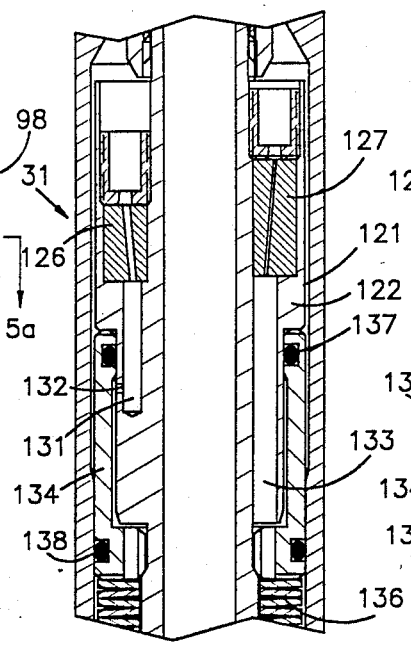
FIG. 5*b* is an enlarged, fragmentary section taken along line 5*b*—5*b* of FIG. 5*a*, illustrating the flow control orifices.
Figure 5C:
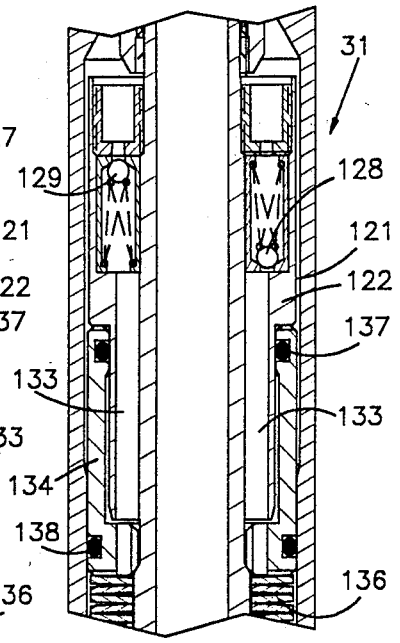
FIG. 5*c* is an enlarged, fragmentary section taken along line 5*c*—5*c* of FIG. 5*a*, illustrating the back check valve and pressure relief valve.
Figure 5A:
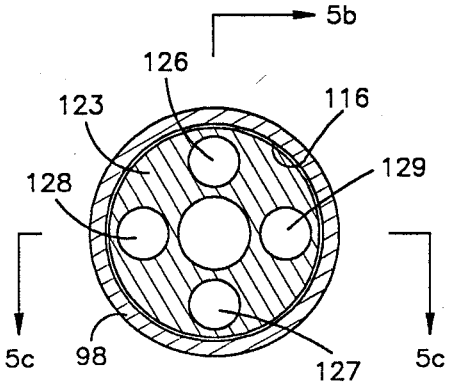
FIG. 5*a* is a cross section taken along line 5*a*—5*a* of FIG. 5.

The time delay dashpot assembly 31 is best illustrated in FIG. 5, and fragmentary, enlarged sections thereof are illustrated in FIGS. 5a through 5c. Referring first to FIG. 5, the cylinder sleeve 98 provides an upper cylinder portion 116 extending from the location 117 to the location 118. Below the location 118, which is the lower end of the upper cylinder portion 116, the cylinder sleeve provides a second cylinder portion 119 having a diameter greater than the diameter of the upper cylinder portion 116. The two cylinder portions 116 and 119 are filled with liquid isolated from the remainder of the tool.

Threaded onto the lower end of the intermediate tubular member 92 is a damper piston assembly 121. Such assembly includes a tubular piston head member 122 providing a piston head portion 123. The piston head assembly 121 is sized to fit the upper cylinder portion 116 with a close fit but providing clearance with the lower cylinder portion 119.

As best illustrated in FIG. 5a, the piston head portion 123 is provided with four flow control devices peripherally spaced around the piston head portion. The first flow control device 126 is a first orifice assembly. The second flow control device 127 is a second orifice assembly. A back check valve assembly 128 constitutes the third flow control device, and a pressure relief valve assembly 129 constitutes the fourth and last flow control device.

Referring now to FIG. 5b, the first flow control device 126 is open to the lower side of the piston head portion 123 through a passage 131 and a lateral port 132. However, the orifice assembly 127 is open through a through-passage 133. The piston head assembly also includes a sleeve valve member 134 which is resiliently biased toward the piston head portion 123 by a set of springs 136. In its normally extended position, the sleeve valve 134 positions a seal 137 above the lateral port 132. Therefore, the orifice assembly 126 is open to the two sides of the piston head portion 123. However, when the differential pressure across the sleeve valve 134 reaches a predetermined value, the force of the spring set 136 is overcome and the sleeve valve moves downwardly until the seal 137 is positioned below the port 132. In such position, the orifice assembly 126 is closed by the cooperation of the seal 137 and the seal 138, and further flow through the orifice assembly 126 is prevented. The seals 138 also provide the seal for the piston assembly 121 with the upper cylinder portion 116.

The shifting of the sleeve valve 134, however, does not affect the operation of the orifice assembly 127. With this two-orifice structure, two rates of damping are provided. The orifice assembly 126 provides a relatively large orifice allowing relatively rapid movement of the piston assembly. However, when the sleeve valve shifts to its operating closed position, the orifice assembly 126 ceases to function and all of the flow must occur through the orifice assembly 127. Such orifice assembly provides a smaller orifice, so the rate of movement of the piston assembly in the damping mode is quite slow, as discussed in greater detail below.

As illustrated in FIG. 5c, the check valve assembly 128 connects the two sides of the piston to allow the piston to move downwardly in a substantially unrestricted manner. Therefore, the orifice assemblies 126 and 127 provide restricted rates of movement only in the upward direction relative to the cylinder sleeve 98. The pressure relief valve 129 performs a safety function of allowing downward movement of the cylinder sleeve 98 relative to the piston assembly. In the event that the orifices become clogged, the pressure relief valve allows movement of the tool to a deflate position so that the tool can be retrieved.

The lower end of the piston head member 122 is threaded into the upper end of a tubular connector 140. The connector member is also threadedly connected to a tubular valve member 141 which extends through a ring gland 142 (illustrated in FIG. 6a) providing inner and outer seals 143. The ring gland 142 is free to slide longitudinally through a limited distance. Ports 144 maintain the lower side of the ring gland 142 to environmental pressure. The gland functions to compensate for changes in volume of the damper liquid due to changes in pressure and temperature as the tool is lowered into the well.

When the piston head assembly 121 is located within the lower end enlarged cylinder portion 119, clearance is provided around the piston head assembly and the piston head assembly can move freely. However, when the piston head assembly 121 enters the upper cylinder portion 116, a dynamic seal is provided between the piston head assembly and the cylinder wall and damping or time delay is provided to prevent rapid movement of the piston head assembly up along the cylinder wall.

The Selector Valve Assembly

Figure 6A:
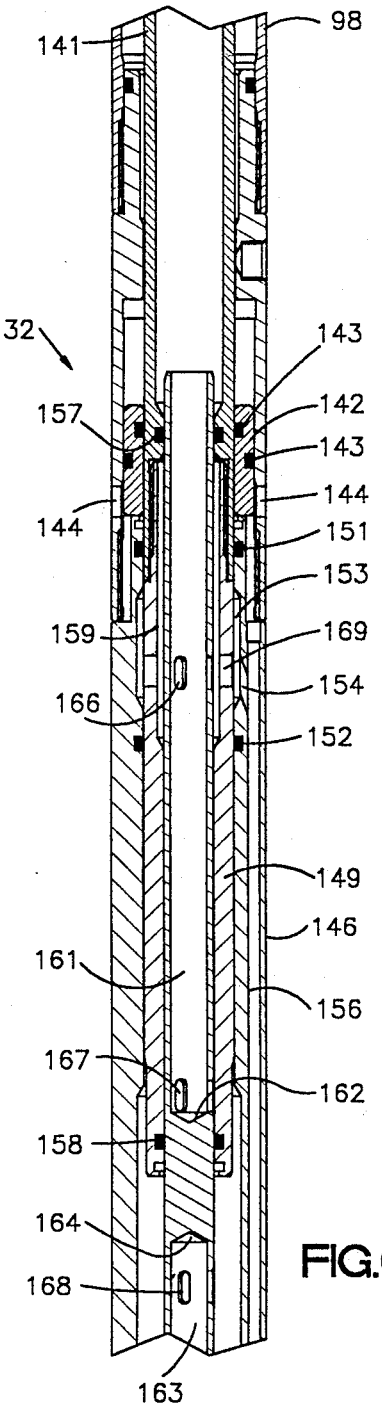
FIG. 6*a* is an enlarged, fragmentary, longitudinal section of a portion of the selector valve illustrating the structural detail thereof.
Figure 6B:
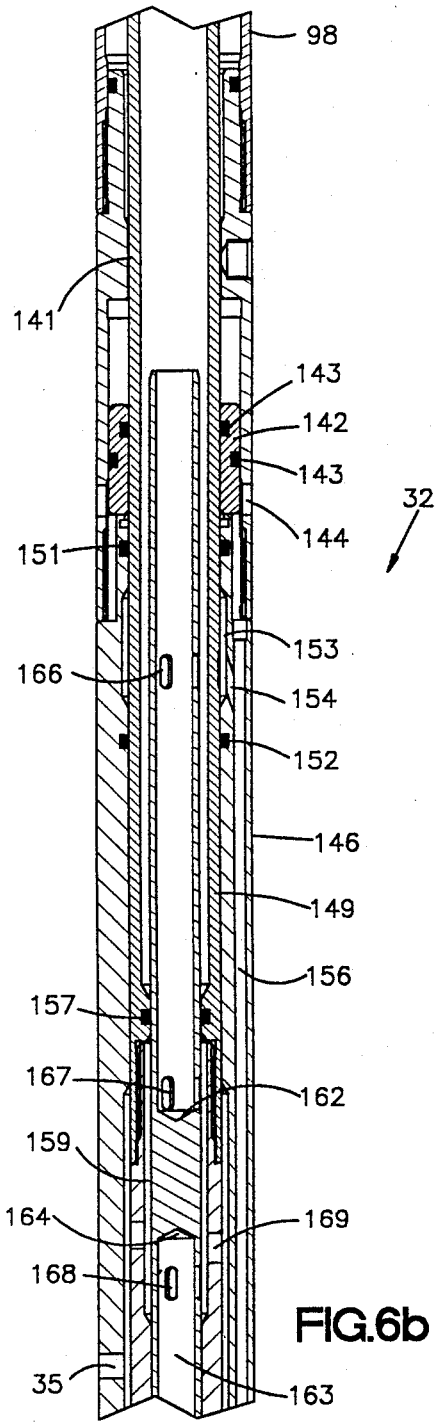
FIG. 6*b* is an enlarged, fragmentary section similar to FIG. 6*a*, but illustrating the selector valve in the spotting or circulating position.
Figure 6C:
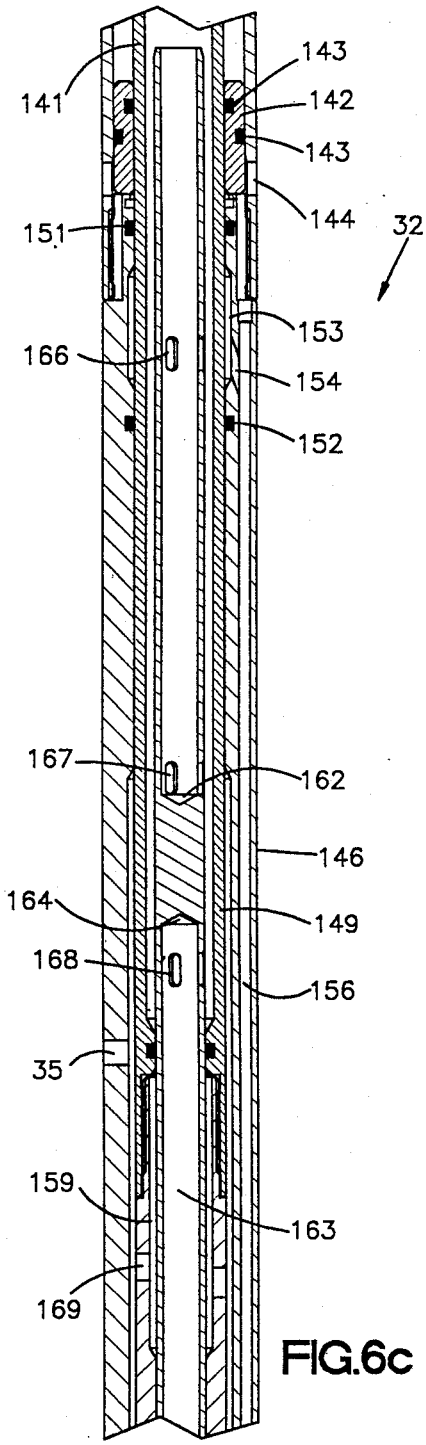
FIG. 6*c* is an enlarged, fragmentary section similar to FIGS. 6*a* and 6*b*, but illustrating the selector valve in the injection position.

The selector valve assembly is best illustrated in FIGS. 6 through 6c, and includes an outer tubular housing member 146 mounted at its upper end on the cylinder sleeve 98 and extending downwardly therefrom. A tubular inner housing member 147 is threaded at its lower end into the outer housing member 146 substantially adjacent to its lower end and cooperates with the outer housing member 146 to provide a valve housing assembly which is fixed against longitudinal movement relative to the cylinder sleeve 98. The tubular valve member 141 and an extension valve member 149 extend between the two housing members 146 and 147 and are longitudinally movable relative thereto to perform the various valving functions required.

Spaced seals 151 and 152 on the outer housing member 146 engage the outer surface of the valve member 141 and 147 on either side of an annular chamber 153 which surrounds the valve member 141 and 147. A port 154 connects the annular chamber 153 with a longitudinally extending passage 156 through which fluid flows to inflate and deflate the packers 33.

When the valve member 141 is positioned as illustrated in FIG. 6a, ports 169 in the valve member 149 are open to the annular chamber 153 and the selector valve is in the inflate/deflate position. The valve member 141 also provides a seal 157 which engages the exterior surface of the inner housing member 147 and which moves therealong when the valve is moved between its operation positions. Similarly, a seal 158 mounted adjacent to the lower end of the valve member 149 engages and provides a running seal with the outer surface of the inner housing member 147.

Between the seal 157 and piston head assembly 121, the valve member is sized to provide clearance with the exterior surface of the inner housing member 147. The valve member also provides an annular chamber 159 surrounding the inner housing member 147 between the seals 157 and 158.

The upper end of the inner housing member 147 is provided with a central passage 161 extending to an end 162. A second longitudinal passage 163 extends up along the inner housing member to an end 164 spaced from the end 162 so that the two passages 161 and 163 are not directly connected. First ports 166 are formed in the wall of the inner housing member 147 at a location approximately midway along the length of the passage 161. Second ports 167 also extend through the wall of the inner housing member 147 substantially adjacent to the lower end of the passage 161. A third set of ports 168 extend through the wall of the inner housing member 147 substantially adjacent to the upper end of the passage 163.

In the run-in position illustrated in FIG. 6*a*, the ports 169 are positioned adjacent to the annular chamber 153 and communication is provided through the ports 166, 169, and 154 to the inflate/deflate passage 156. In such position, the packers can be inflated or deflated. In such position. however, the seal 158 engages the portion of the inner housing member between the ends of the two passages 161 and 163 so the remainder of the tool is isolated from the liquid pressure in the upper portion of the tool.

When the valve member 141 is moved to the circulating position illustrated in FIG. 6*b*, the port 169 is spaced from the annular chamber 153 so the packer inflate/deflate passage 156 is isolated and the packers remain inflated. In such position, the port 169 is in communication with the annular chamber 159 and fluid flow is provided thereto through the ports 168, which are then located below the seal 157. In such condition, fluid pumped down to the tool passes through the port 169 and through the circulation port 35 formed in the outer housing member 146. Also in such valve position, the zone between the packers is connected to the port 35.

The valve member 141 is also movable to a third or inject position illustrated in FIG. 6*c* in which the port 169 is isolated from the interior passage 163 by the seals 157 and 158. However, in this position, communication is provided with the lower passage 163 through the ports 168, which are then located above the seal 157. The time delay selector valve is therefore operable in three different positions to perform in sequence the various operations required for the treatment of the well.

Figure 7:
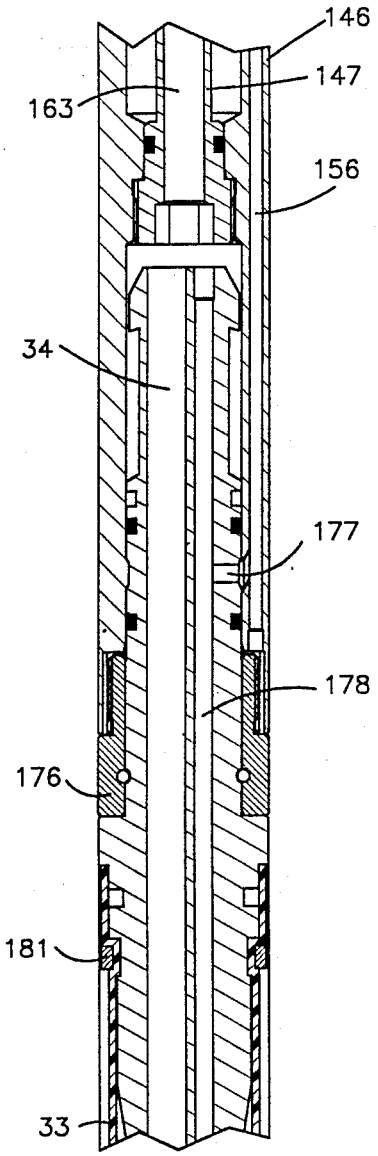
FIG. 7 is an enlarged, fragmentary section illustrating the connection of the packer subassembly to the selector valve.

FIG. 7 is an enlarged, fragmentary view illustrating the connection between the selector valve and the packer subassembly illustrated in FIG. 8. The packer assembly is connected to the lower end of the selector valve assembly 32 by a tubular coupler 176 threaded into the lower end of the outer housing member 146. The coupling provides the passage 34, which is open to and in communication with the second passage 163 in the inner housing member 147. The coupling also provides a lateral port 177 interconnecting the inflate-deflate passage 156 and a passage 178 along which fluid flows to inflate and deflate the packers during such phases of the tool operation.

Referring now to FIG. 8, the coupling member extends down along the tool through an upper inflatable packer 33, which is formed of a tube of elastomeric material clamped at its upper end at 181 and at its lower end 182 to the exterior of the tubular coupler 176. The upper inflatable packer 33 is connected to the inflate/deflate passage 178 by a lateral port 183 open to the interior thereof. Therefore, when the selector valve is in the inflate or deflate position, pressure communication is provided to the interior of the packer for inflation or deflation thereof. The tubular coupler is also provided with a second inflate/deflate passage 184 which is spaced from the inflate/deflate passage 178 and is also connected to the interior of the upper packer 33 through a port 186. The inflate/deflate passage 184 is connected at its lower end to an additional inflate/deflate passage 187 formed of a tubular member which extends between the upper and lower packers. In FIG. 8, only one of the packers is illustrate in order to simplify the drawings, however, it should be understood that a lower packer similar to the upper packer 33 illustrated in FIG. 8 is usually provided at the lower end of the tool and is inflated and deflated through the inflate/deflate passage 187.

The passage 34 is open to the zone between the two packers through a port 191. A passage system 189 is also provided to bypass the packers and connect the portion of the well above the upper packer to the portion of the well below the lower packer, even when the zone between the packers is isolated from the remainder of the well. In order to simplify the drawing, the passage system 189 is only illustrated in the schematic FIGS. 9 through 14.

Operation

FIGS. 9 through 14 schematically illustrate the sequence of operations of the tool when a well treatment is to be performed. In each instance, the corresponding condition of the J-lock cam assembly 29 and the weight indication are indicated by the weight scale 16.

Figure 9:
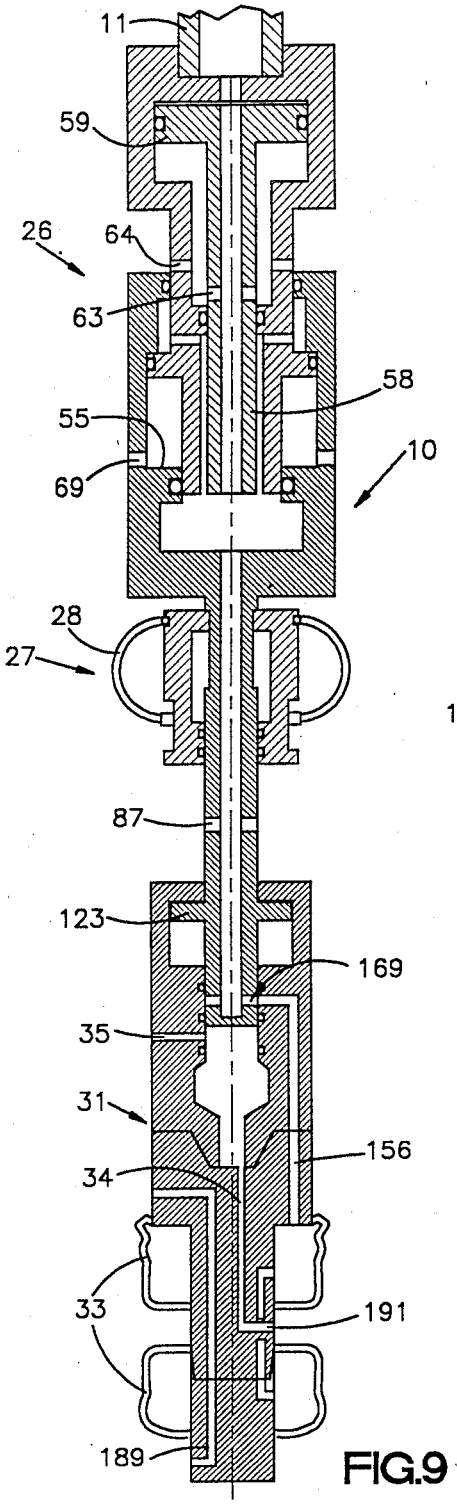
FIGS. 9 through 14 are schematic illustrations of the tool as it is progressively operated through one complete cycle of operation of injecting treatment fluid into a selected strata of a well.
Figure 9B:
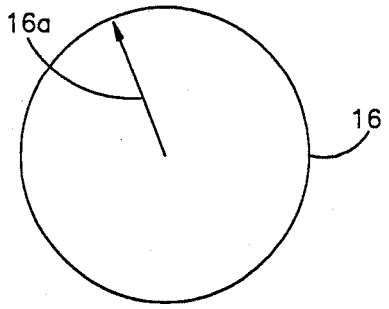
Figure 9A:
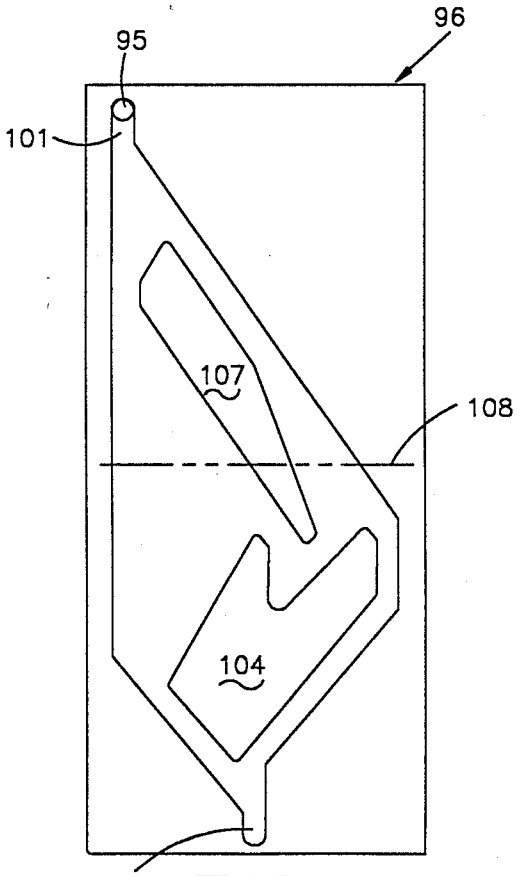

Referring now to FIGS. 9, 9*a*, and 9*b*, the tool is schematically represented in its run-in condition. In such condition, the tool is lowered into the well by lowering the support tube 11 into the well with the tool secured on the end thereof. During the run-in, the drag valve assembly 27 is held in the open position by the frictional drag of the leaf springs 28 along the surface of the well. Consequently, the liquid being pumped down to the tool is vented to the environment through the drag valve 27. Further, during the run-in, the time delay assembly 31 remains in its extended position and the follower projection 95 is positioned in the upper pocket 101. Consequently, the selector valve port 169 is open to the inflate/deflate passage 156. Since the internal pressure within the tool is equal to the surrounding pressure, the packers 33 remain deflated.

As the tool is lowered into the well, the weight indicated by the weight scale 16 is monitored by the operator and increases as the tool is lowered to greater depth. During the lowering of the tool, the operator also monitors the depth of the tool indicated by the measuring device 17, illustrated in FIG. 1.

In many instances, a tube end locator (not shown, but known to those skilled in the art) is also provided at the upper end of the tool so that the operator can establish when the tool is at the lower end of the production tube and correct the depth measurement provided by the measuring device 17 to compensate for stretching the tube 11 and also any slippage which might occur. This permits the operator to accurately locate the tool at the strata which is to be treated.

As the tool approaches the position at the strata to be treated, the weight reading 16*a* on the weight scale 16 is logged by the operator. That weight reading will be less than the actual weight of the tool and the string being supported by the grippers 14 because of the frictional drag of the tube and the tool as they are moving down along the well surface.

Generally, the operator lowers the tool to a position a few feet below the position in which the treatment is to occur before stopping the tool. The operator then reverses the grippers and raises the tool to the location in which treatment is to occur. As the tool is being raised the few feet back to the treatment position, the operator also notes the weight indication **16*b* under a raising condition, which is greater than the run-in weight 16*a***, again due to the frictional drag of the string.

Figure 10:
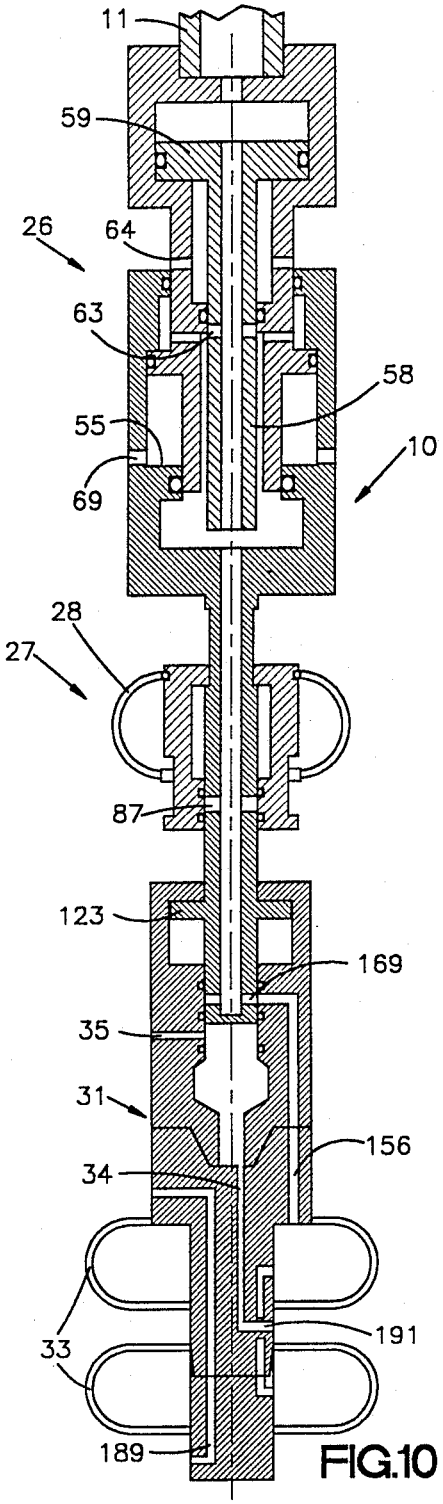
Figure 10B:
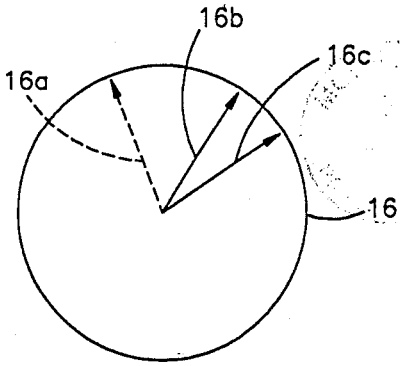
FIGS. 10*a* and 10*b* illustrate the J-lock assembly position and weight scale reading corresponding to the condition of FIG. 10.
Figure 10A:
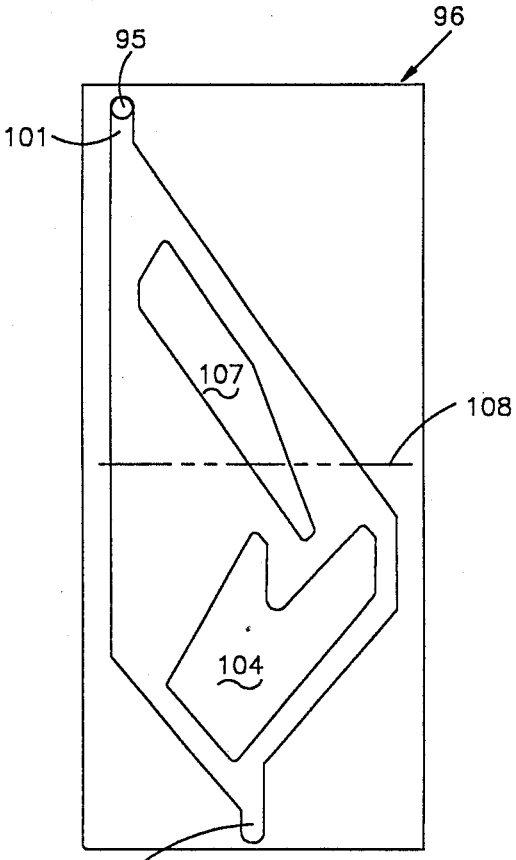

Such raising movement causes the drag valve 27 to move down along the tool to the closed position illustrated in FIG. 10. The operator will note that the previously-noted down-load **16*a* indicated during run-in will increase, as indicated at 16*b* in FIG. 10*b***, as the tool is raised a short distance back to the treatment position.

After the tool is properly positioned at the treatment location, the rate of flow of the fluid to the tool is increased. This produces a sufficient pressure differential across the piston head 59 to move the piston down, closing the equalizing valve 26. Since the equalizing valve 26 and the drag valve 27 are closed, the pressure within the tool increases, causing inflation of the packers 33, as indicated in FIG. 10.

The operator then increases the force exerted by the grippers to increase the tension in the tube 11 to verify that the packers have in fact been inflated. Since the packers lock the tool against movement along the well when they are inflated, increased tension will cause an increase in the weight reading indicated by the arrow **16*c* beyond the up-load reading indicated at 16*b***.

In some instances, the tool may encounter obstacles during the run-in operation which cause the J-lock assembly and the selector valve to move to an inject position in which the follower projection is located within the pocket 102. This does not present a problem if the tool is not extended after the tool is raised up a short distance back to the treatment position. The pressure within the tool causes extension of the selector valve due to its action against the area of the inner housing member 147. This returns the selector valve to the extended position in which the follower projection 95 is in the pocket 101.

Since the weight of the tool is not supported in that instance, and since the extension force produced by the tool pressure is relatively small, the pressure above the piston head 123 of the time delay assembly 31 remains below the pressure required to move the sleeve valve 134 against the action of the springs 136 so the large orifice assembly 146 remains open, permitting substantially free travel of the time delay valve assembly 31 to its extended position for proper inflation of the packers.

Figure 11:
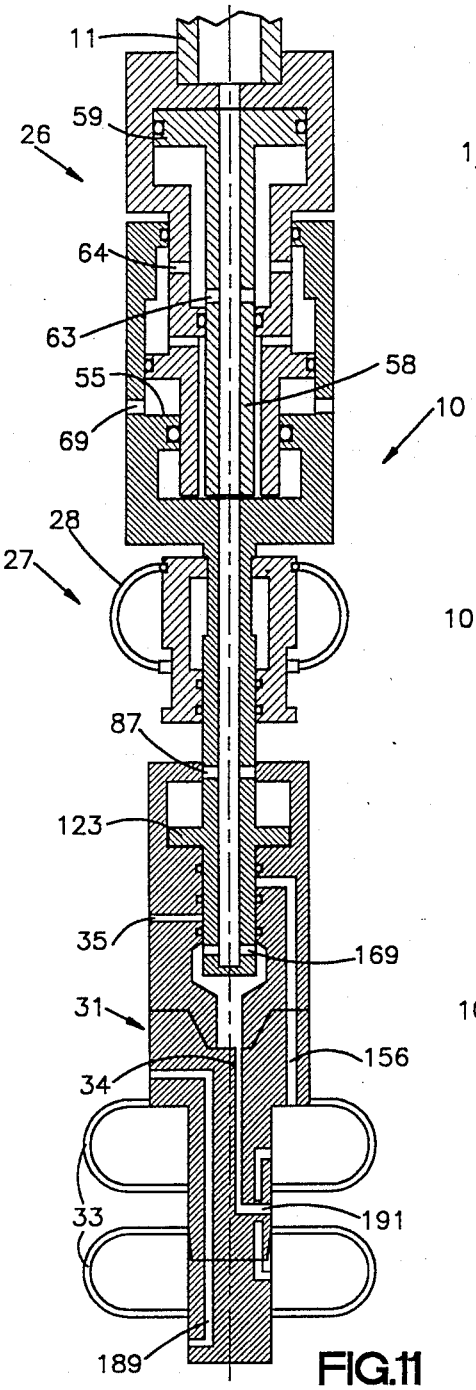
Figure 11B:
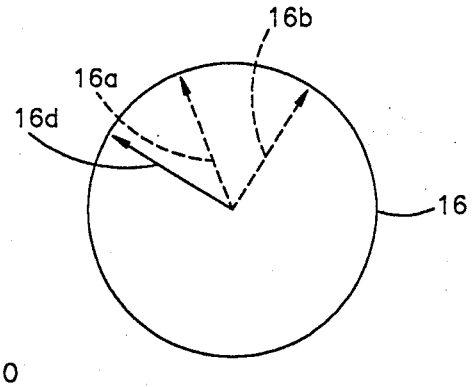
FIGS. 11*a* and 11*b* illustrate the corresponding J-lock assembly position and the weight scale reading.
Figure 11A:
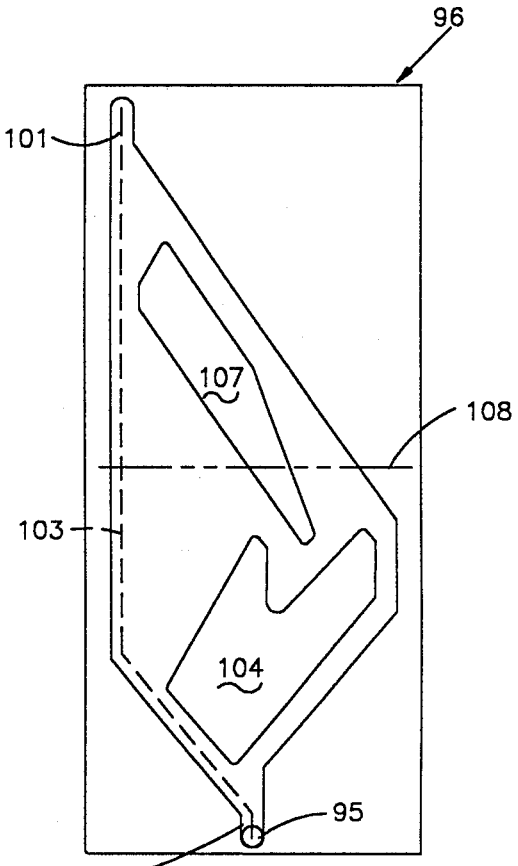

After the packers are properly inflated, as determined by the weight indication **16*c*, the load supported by the grippers 14 is reduced and the tool moves to a position illustrated in FIG. 11, in which the selector valve assembly moves downwardly relative to he tool body causing the follower projection 95 to move along the path 103 into the pocket 102, indicated in FIG. 11*a*. This permits the testing of the strata to determine if it will accept fluid. This movement of the selector valve isolates the inflate/deflate passage 156 so the packers 33 remain in their inflated condition and continue to isolate the zone of the well therebetween from the remaining zones of the well. A weight indication 16*d* less than the run-in weight 16*a*** establishes that the packers remain inflated.

The movement of the upper portions of the tool in the downward direction tends to cause the drag valve to move upwardly to its upward limit position, as illustrated in FIG. 11, but the downward movement of the selector valve positions the ports 87 so that they are closed by the lower housing assembly of the tool. Therefore, any liquid or other fluid pumped down the tube 11 into the tool is directed to the zone between the packers. The operator at this time determines whether or not the strata, which is isolated from the remainder of the well and which is to be treated, will accept fluid.

It should be noted that when the tool string is lowered to the position of FIG. 11, the lower end of the piston member 58 engages a shoulder on the lower housing and the piston member is moved back to its upper position within the equalizer valve assembly. However, the equalizer valve remains closed because the port 64 is closed.

Figure 12:
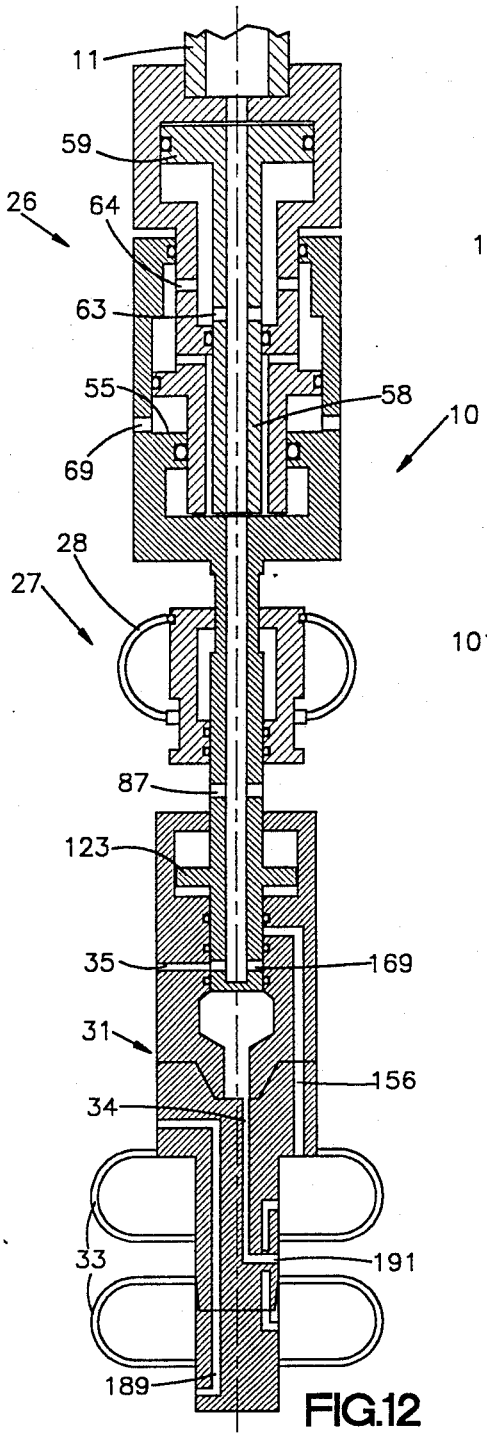

At the completion of the injecting testing operation, the rate of flow of the fluid down to the tool is reduced and the powered grippers 14 are operated to raise the upper portion of the tool relative to the lower portion in a sequence which positions the tool in the position for spotting the treatment fluid indicated in FIG. 12. By increasing the tension to a value above the up-load **16*b***, the operator is assured that sufficient tension is present to extend the upper portion of the tool relative to the lower portion.

Substantially free travel is provided until the tool extends beyond the location indicated by the line 108, since the initial portion of extension occurs while the damper piston head portion 123 and the sleeve valve 134 are moving along the lower cylinder portion 119, which is sufficiently large to allow fluid to bypass the piston assembly.

Figure 12B:
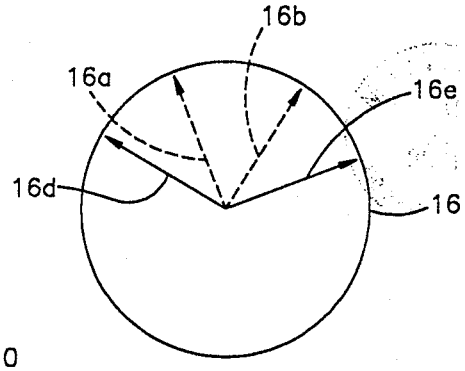
Figure 12A:
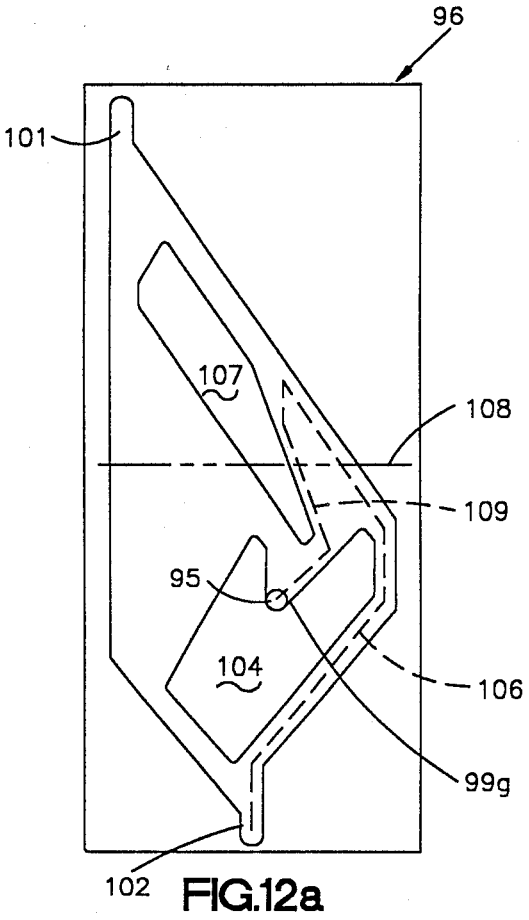

When the position indicated by the line 108 is reached, the piston assembly moves into the upper cylinder portion 116 and continued upward movement of the piston assembly requires flow through the orifices. The rate of upward movement, however, causes sufficient differential pressure to occur across the sleeve valve 134 to cause it to move against the action of the springs 136 to close the larger orifice assembly 126. Thereafter, the only open path of flow past the piston is provided by the small orifice assembly 127, which is sized to require at least about three minutes for the valve to move to a fully extended position. As soon as the load on the grippers increases, as indicated at **16*e* in FIG. 12*b***, the operator is provided with an indication that the damping or time delay function is commenced. The operator then continues to raise the upper portion of the tool for a period of time less than two minutes to ensure that the selector valve does not fully extend.

During this upward movement of the tool, the follower projection 95 moves up along the cam surfaces along the path 106 and is positioned alongside of the island cam 107. The operator then decreases the tension on the support tube 11 and causes the follower projection 95 to move down along the cam surface along the path 109 into the J-lock position at **99*g*. In such position, the port 169 in the selector valve is in alignment with the circulation port 35 in the lower tool housing. Such downward movement may also cause the drag valve 27 to open, as indicated in FIG. 12. Also, the upper housing assembly of the equalizing valve assembly 26 moves to its compressed position during this downward movement. A weight indication 16***d* less than the run-in weight 16*a* again confirms that the packers are still inflated.

The spotting operation is commenced by moving the selector valve 19, illustrated in FIG. 1, to connect the treatment liquid reservoir 22 to the pump 18 so that the treatment fluid is pumped down the support tube 11 to the tool and the inflation fluid is displaced from the tube through the port 35 and/or the ports 87, both of which are open to the environment. This spotting operation functions to expel the inflation fluid from the tube 11 and to position the leading edge of the treatment fluid at the tool for subsequent injection.

Figure 13:
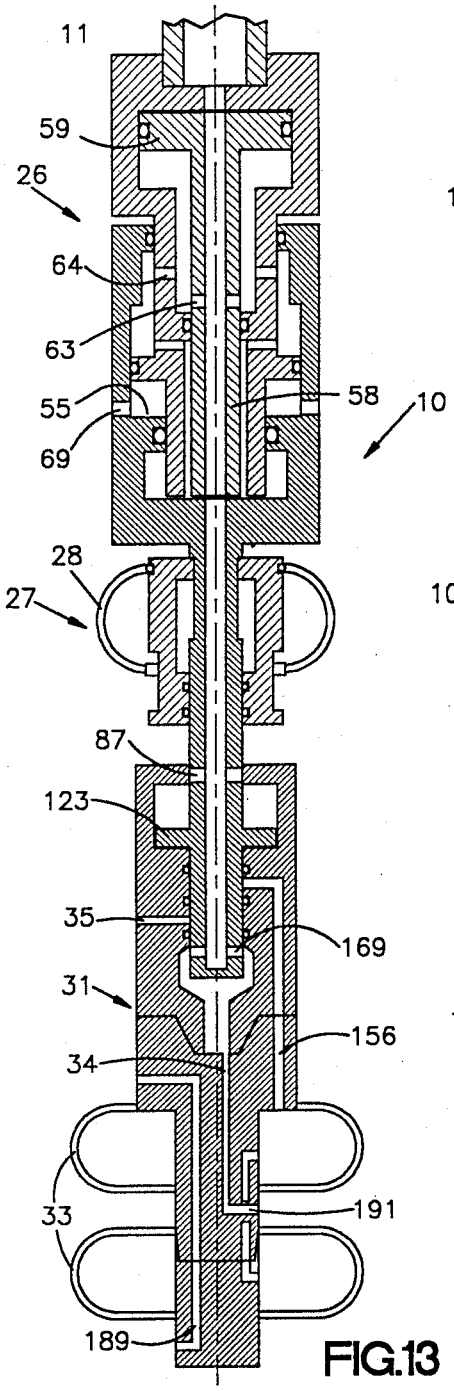
Figure 13B:
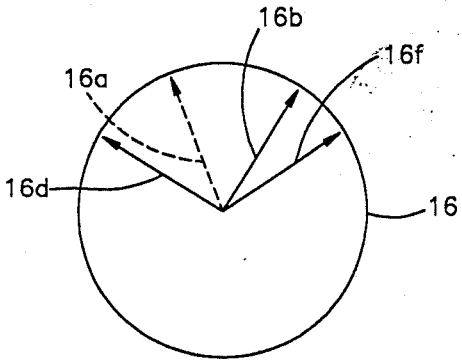
FIGS. 13*a* and 13*b* illustrate the corresponding condition of the J-lock assembly and the weight scale reading.
Figure 13A:
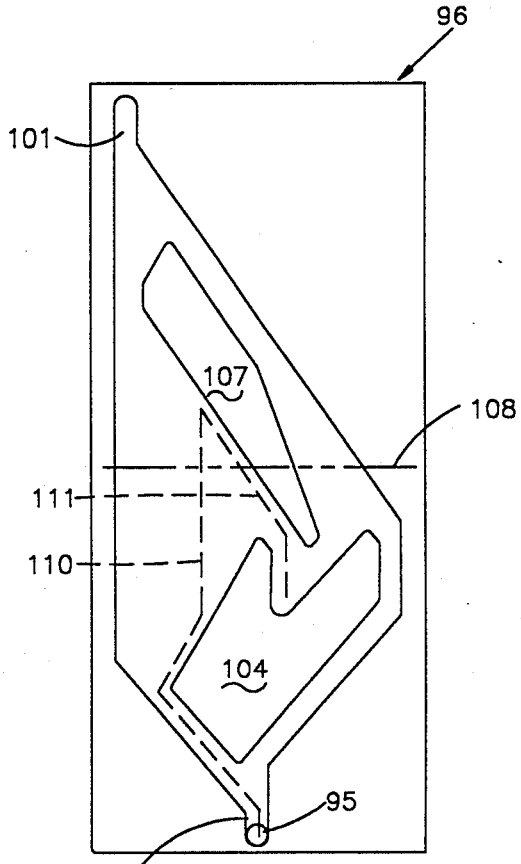
Figure 14:
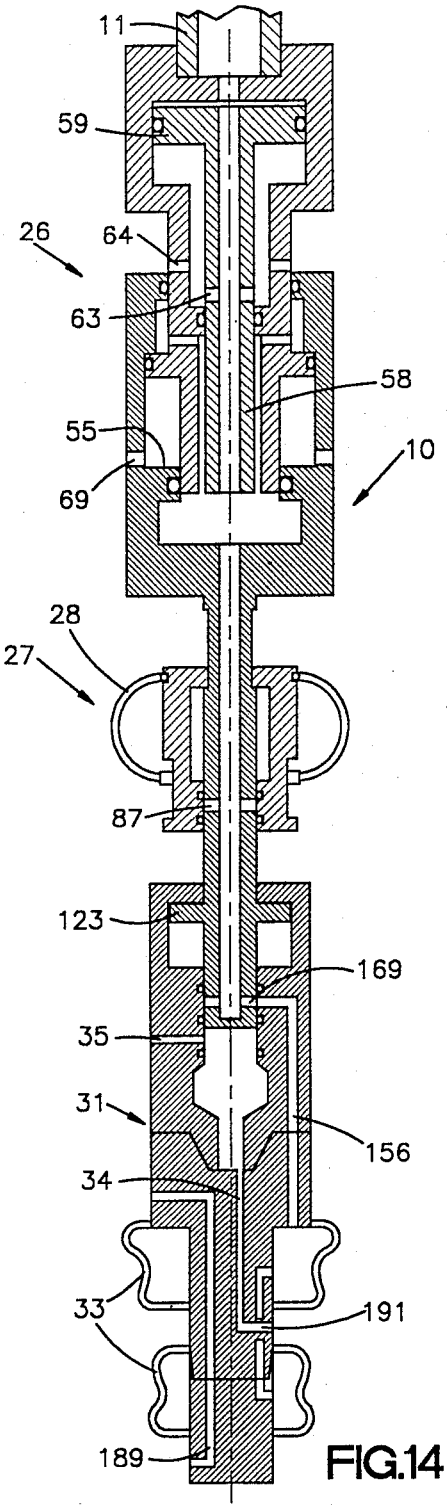
Figure 14B:
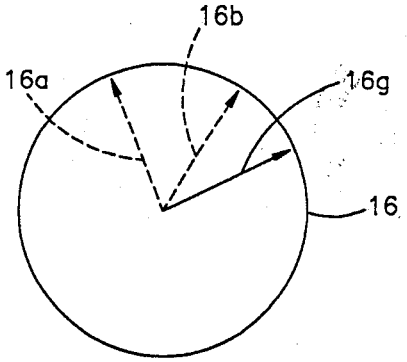
Figure 14A:
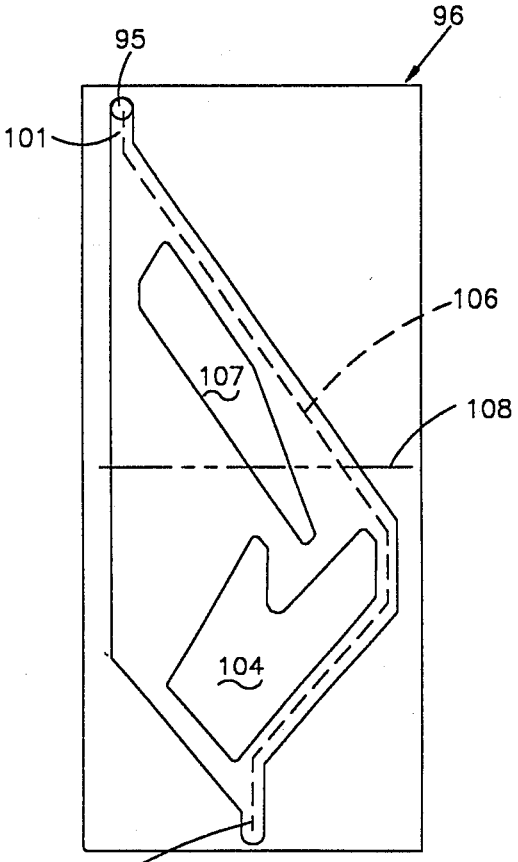

The operator then operates the power grippers to increase the tension in the support tube 11 to raise the follower projection 95 out of the spotting pocket 99*g* until it moves past the position indicated by the line 108 in FIG. 13*a* along the path 111. The fact that the tool has been raised into the damping zone above the position of 108 is again indicated by an increase in the weight to 16*f* on the grippers. Here again, the tension is only maintained for less than two minutes of the three-minute time delay provided by the time delay assembly to ensure that the valve does not move back to the inflate/deflate position.

The load on the grippers is then decreased, causing the follower projection 95 to move down along the path 110 back to the lower pocket 102. This positions the valve for injection, as illustrated in FIG. 13. Again, a weight reading 16*d* less than the run-in weight 16*a* establishes that the packers remain inflated. The treatment fluid is then pumped down to the tool and is injected into the strata between the two packers 33.

At the completion of the injection phase of the operation, the operator shuts off the pump and increases the load on the grippers to a value 16*g* greater than the up-load value indicated at 16*b* to again move the follower projection 95 up along the cam surface 99 along the path 106. When the damper again moves into the damping position, the tension is maintained on the support tube for more than three minutes, so the follower projection 95 moves back to the upper pocket 101.

Once the selector valve reaches the deflate position, the inflate/deflate passage 156 is opened through the ports 63 and 64 and the pressure is equalized through the equalizing valve 26. This causes the packers 33 to deflate. A decrease in weight reading from 16*f* back to the pull-up weight 16*b* establishes that the packers are deflated.

At this time, the tool can be moved to another location where treatment is required and the cycle can be repeated, or the tool can be raised up out of the well.

Figure 15:
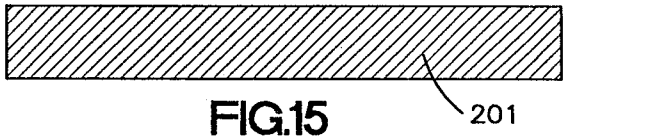
FIGS. 15 through 15*c* schematically illustrate the production of the internal camming surfaces provided by the J-lock assembly.
Figure 15A:
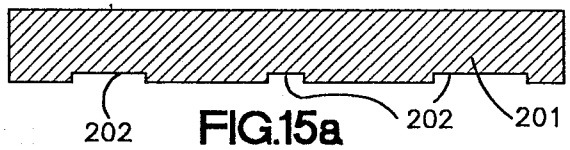
Figure 15B:
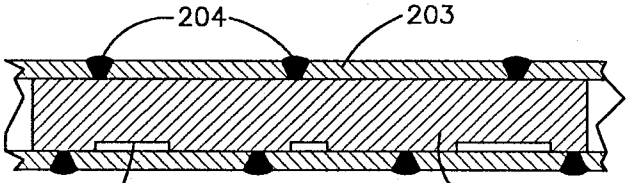
Figure 15C:
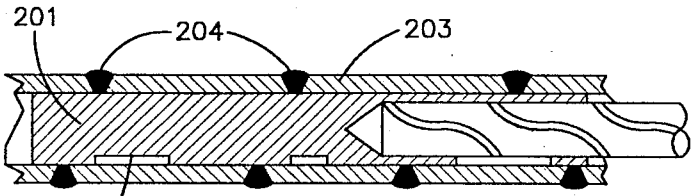

FIGS. 15 through 15*c* illustrate a novel and improved method of producing an internal camming surface along the inside of a relatively long and relatively narrow tubular member. As a first step in the formation of the camming surface, a solid cylindrical mandrel 201 is selected having a diameter equal to the maximum diameter of the camming surfaces. The mandrel 201 is then machined along its outer surface to cut into the outer surface thereof the required camming surface structure. For example, in producing the J-lock cam assembly, a series of cam grooves 202 are cut into the outer surface of the mandrel 201, as illustrated in FIG. 15*a*. Once the camming grooves have been cut into the outer surface of the mandrel 201, the mandrel is inserted into the outer tube 203. The mandrel is connected to the outer tubular sleeve 193 by button welds 204 which fill openings previously formed in the tubular sleeve 203. Such button welds are appropriately placed to provide a connection between any island cam portions, such as the island portions 104 and 107, and also to connect other portions of the mandrel to the sleeve. Thereafter, the central portion of the mandrel is bored out, as illustrated in FIG. 15*c* to a diameter which exceeds the inner diameter of the cam grooves. In this way, external machining can be provided to produce intricate camming surfaces along the inside of a relatively narrow and relatively long tube.

With this invention, a treatment tool is provided which can be controlled with certainty from the well head by noting changes in the load on the power grippers as indicated by the weighing scale 16. In each step of the operation, changes in the weight indicated by the scale 16 provide the operator with an indication that the previous portion of the cycle has been properly and successfully completed and that the tool is in proper condition for a subsequent operation. Because weights, and not distances, are utilized to control the operation of the tool, any slippage occurring in the depth measuring device 17 or stretching of the support tube 11 do not adversely affect the operation of the tool. Further, it is not necessary to rotate the tube to control the operation of the tool. Still further, it is not necessary to rely upon electronics or dropping balls to determine the condition of the tool and the simple weight scale 16 provides the operator with all of the information he needs to have concerning the operation of the tool through a complete cycle. Still further, with this invention a small diameter tool is provided that can fit a relatively small production tube and operate in a casing having a substantially greater diameter.

Although the preferred embodiment of this invention has been shown and described, it should be understood that various modifications and rearrangements of the parts may be resorted to without departing from the scope of the invention as disclosed and claimed herein.

What is claimed is:

1. A tool for treating subterranean wells, comprising an elongated body assembly adapted to be connected at one end to a support tube, inflatable packer means mounted on said body assembly movable between a deflated position allowing the tool to be moved along the well and an inflated position for sealing with the surface of the well to isolate one portion of the well surface from other portions of the well surface, and valve means in said body assembly operable without rotation of said support tube to control said tool by moving sequentially (a) to a first position for inflating said packer means;
(b) to a second position for circulating fluid to permit the flow of treatment fluid to said tool;
(c) to a third position for injection said treatment fluid into said one portion of said well; and
(d) to a position for deflating said packers at the completion of said injection of said treatment fluid, said valve means providing time delay means requiring a predetermined period of time for said valve means to move to said first position.

2. A tool as set forth in claim 1, wherein one portion of said body assembly is longitudinally movable relative to the other portions of said body assembly, and said valve means is moved between said positions by longitudinal movement of said one portion relative to said other portions of said body assembly.

3. A tool as set forth in claim 2, wherein said packer means are mounted on said other portions of said body assembly.

4. A tool as set forth in claim 3, wherein said one portion of said body assembly is moved longitudinally relative to said other portions of said body assembly solely by adjusting the tension in said support tube.

5. A tool as set forth in claim 1, wherein said tool includes an equalizer valve which opens to vent said tool when said valve means moves to said position for deflating said packers.

6. A tool for treating subterranean wells, comprising an elongated body assembly adapted to be connected at one end to a support tube, inflatable packer means mounted on said body assembly movable between a deflated position allowing the tool to be moved along the well and an inflated position for sealing with the surface of the well to isolate one portion of the well surface from other portions of the well surface, and valve means in said body assembly operable to control said tool by moving sequentially (a) to a first position for inflating said packer means;
(b) to a second position for circulating fluid to permit the flow of treatment fluid to said tool;
(c) to a third position for injecting said treatment fluid into said one portion of said well; and
(d) to a position for deflating said packers at the completion of said injection of said treatment fluid, said valve means providing time delay means requiring a predetermined period of time for said valve means to move to said first position, said second position of said valve means being intermediate said first and third positions, and said valve means including latching means operable to hold said valve means in said second position, said time delay means cooperating with said latching means when moving said valve from said third position to said second position.

7. A tool for treating subterranean wells, comprising an elongated body assembly adapted to be connected at one end to a support tube, inflatable packer means mounted on said body assembly movable between a deflated position allowing the tool to be moved along the well and an inflated position for sealing with the surface of the well to isolate one portion of the well surface from other portions of the well surface, and valve means in said body assembly operable to control said tool by moving sequentially (a) to a first position for inflating said packer means;
(b) to a second position for circulating fluid to permit the flow of treatment fluid to said tool;
(c) to a third position for injecting said treatment fluid into said one portion of said well; and
(d) to a position for deflating said packers at the completion of said injection of said treatment fluid, said valve means providing time delay means requiring a predetermined period of time for said valve means to move to said first position, said time delay means including a liquid-filled cylinder portion in said body assembly and a piston movable along said cylinder portion, said time delay means also including orifice means connecting opposite sides of said piston restricting liquid flow past said piston as said piston moves relative to said cylinder portion in one direction and which limits the rate of said relative movement.

8. A tool as set forth in claim 7, wherein said orifice means permits relative movement at a first rate when the differential pressure across said piston is below a predetermined value and reduces the rate of said relative movement when the differential pressure across said piston is above said predetermined value.

9. A tool as set forth in claim 8, wherein said orifice means includes first and second orifices, both of said orifices being open when the differential pressure across said piston is below said predetermined value, and one of said orifices is closed when the differential pressure across said piston is above said predetermined value.

10. A tool as set forth in claim 7, wherein a check valve bypasses said orifice means when said piston moves relative to said cylinder portion in a direction opposite to said one direction.

11. A tool as set forth in claim 10, wherein a pressure relief valve bypasses said orifice when the differential pressure across said piston exceeds a second predetermined value substantially greater than said first predetermined value.

12. A tool as set forth in claim 11, wherein said orifice means, said check valve, and said pressure relief valve are all located in said piston.

13. A tool for treating subterranean wells, comprising an elongated body assembly adapted to be connected at one end to a support tube, inflatable packer means mounted on said body assembly movable between a deflated position allowing the tool to be moved along the well and an inflated position for sealing with the surface of the well to isolate one portion of the well surface from other portions of the well surface, and valve means in said body assembly operable to control said tool by moving sequentially (a) to a first position for inflating said packer means;
(b) to a second position for circulating fluid to permit the flow of treatment fluid to said tool;
(c) to a third position for injecting said treatment fluid into said one portion of said well; and
(d) to a position for deflating said packers at the completion of said injection of said treatment fluid, said valve means providing time delay means requiring a predetermined period of time for said valve means to move to said first position, said time delay means preventing movement of said valve means to said first position for a predetermined length of time, said valve means including latching means operable to hold said valve means in said second position, said valve means being movable to said second position by exerting force to move said valve means from said third position toward said first position for a length of time less than said predetermined length of time.

14. A tool as set forth in claim 11, wherein said latch means includes a J-lock cam system engageable to hold said valve means in said second position only when said valve means moves from said third position and which permits direct movement of said valve means from said first position to said third position.

15. A tool for use in the treatment of subterranean wells comprising an elongated tubular housing, a time delay valve in said housing movable between first, second, and third operating positions for controlling a sequence of treatment operations including isolation of a portion of the well from remaining portions thereof and injecting treatment fluids into such portions, said valve including a cam assembly providing a positioning portion positioning said valve in said second operating position, said valve also including time delay means operable to delay movement of said valve to said first operating position from said second and third operating positions for a predetermined length of time, said valve means also providing a connector portion for moving said valve relative to said housing in response to changes in forces applied to said connector portion, said time delay means permitting substantially free movement of said valve in one direction from said third operating position to locations beyond said second operating position and thereafter preventing continued movement in said one direction to said first operating position for said predetermined length of time, said cam assembly and said time delay means operating to cause movement of said valve to said second operating position when a force is applied to said connector causing movement from said third position in said one direction for a period of time less than said predetermined length of time.

16. A tool as set forth in claim 15, wherein said time delay means includes a piston assembly movable along a liquid-filled cylinder, and orifice means connected between opposite sides of said piston assembly, said orifice means operating to delay said movement to said first position for said predetermined length of time.

17. A tool as set forth in claim 16, wherein said cylinder provides a first cylinder portion providing clearance with respect to said piston assembly and a second cylinder portion providing a close fit with said piston assembly, said orifice means functioning to provide said time delay only when said piston moves along said second cylinder portion.

18. A tool as set forth in claim 17, wherein said piston assembly moves along said first cylindrical portion as it moves from said first operating position past said second operating position.

19. A tool as set forth in claim 16, wherein said orifice means includes first and second orifices, and pressure-responsive means close said first orifice when the differential pressure across said piston assembly exceeds a predetermined value.

20. A tool as set forth in claim 16, wherein a back check valve provides substantially free movement of said piston assembly in a direction opposite said one direction.

21. A method of treating subterranean wells with a treatment tool having inflatable packer means and a selector valve operable through a cycle to sequentially (a) inflate said package, (b) inject treatment fluid, and (c) deflate said packers, comprising connecting said tool to a support tube, lowering said tube to a strata within said well where treatment is required, and thereafter operating said tool through said cycle, solely by adjusting the tension load on said support tube without rotating said support tube.

22. A method as set forth in claim 21, including providing a weight scale operable to establish the load on said support tube at the well head, and adjusting the tension in said support tube based on weight indications provided by said weight scale.

23. A method as set forth in claim 22, including verifying inflation of said packers by weight indications provided by said weight scale.

24. A method as set forth in claim 23, including providing said selector valve with a spotting position for spotting treatment fluid at said tool, and sequencing said selector valve to said spotting position by adjusting the tension in said support tube for a predetermined length of time.

25. A method of injecting treatment liquid into selected zones of a subterranean well, comprising lowering a tool providing packer means into said well with a one-piece support tube to position said tool at said selected zone, and sequentially:

(a) increasing the tension on said support tube to raise said tool while pumping liquid into said tool through said support tube to inflate said packer means to isolate said selected zone;

(b) reducing the tension in said support tube and continuing to pump liquid to said tool to determine if liquid can be injected into said selected zone;

(c) increasing the tension on said tube at least for a limited period of time to cause said tool to permit circulation of liquid from said support tube into portions of said well other than said selected zone while pumping treatment liquid along said support tube to said tool; and (d) increasing the tension in said support tube for at least a period of time to shift said tool to an injection condition permitting treatment liquid supplied to said tool through said support tube to be injected into said selected zone.

26. A method as set forth in claim 25, including thereafter increasing said tension in said support tube to release pressure within said tool to deflate said packers.

* * * * *